United States Patent [19]

Lefferts

[11] Patent Number: 4,796,749

[45] Date of Patent: Jan. 10, 1989

[54] SPIRAL LINK BELT WITH COMPOSITE HELICES

[75] Inventor: Johannes Lefferts, Enschede, Netherlands

[73] Assignee: Siteg Siebtechnik GmbH, Ahau-Alstatte, Fed. Rep. of Germany

[21] Appl. No.: 120,139

[22] Filed: Nov. 6, 1987

[30] Foreign Application Priority Data

Nov. 7, 1986 [DE] Fed. Rep. of Germany ..... 3638036

[51] Int. Cl.[4] ..... B65G 17/06

[52] U.S. Cl. ..... 198/851; 198/853; 428/222; 245/6

[58] Field of Search ..... 198/851, 853; 428/222, 428/221, 371; 245/4, 5, 6, 9

[56] References Cited

U.S. PATENT DOCUMENTS

| | | | |
|---|---|---|---|
| 4,345,730 | 8/1982 | Leuvelink | 428/222 X |
| 4,346,138 | 8/1982 | Lefferts | 198/853 X |
| 4,362,776 | 12/1982 | Lefferts et al. | 198/853 X |
| 4,392,902 | 7/1983 | Lefferts | 428/222 X |
| 4,395,308 | 7/1983 | Dawes | 428/222 X |
| 4,500,590 | 2/1985 | Smith | 198/853 X |
| 4,502,595 | 3/1985 | Wheeldon | 198/853 |
| 4,528,236 | 7/1985 | Finn et al. | 428/222 |
| 4,564,551 | 1/1986 | Best | 428/222 |
| 4,567,077 | 1/1986 | Gauthier | 428/222 X |
| 4,575,472 | 3/1986 | Lefferts | 428/371 X |
| 4,650,709 | 3/1987 | Lefferts | 428/222 |
| 4,676,369 | 6/1987 | Borel | 198/853 |
| 4,719,139 | 1/1988 | Gauthier | 198/853 X |

FOREIGN PATENT DOCUMENTS

| | | | |
|---|---|---|---|
| 2938221 | 10/1980 | Fed. Rep. of Germany . | |
| 3221255 | 12/1983 | Fed. Rep. of Germany | 198/853 |
| 3534264 | 4/1987 | Fed. Rep. of Germany | 198/853 |
| 2141749 | 1/1985 | United Kingdom | 198/853 |

*Primary Examiner*—Frank E. Werner
*Assistant Examiner*—D. Glenn Dayoan
*Attorney, Agent, or Firm*—Sughrue, Mion, Zinn, Macpeak & Seas

[57] ABSTRACT

A spiral link belt comprising a multiplicity of synthetic resin helices consisting of flat winding lets and winding arcs with the winding arcs of a helix meshing in zipper fashion with the winding arcs of the adjacent helix. Pintle wires are inserted into the channels formed by the meshing winding arcs of each two helices. A plurality of helices consist of at least two components, the first component being disposed on the inside of the helix and the second component being disposed on the outside of the helix. Preferably, the second component which is disposed on the outside of the helix, is embedded in a groove in the first component.

7 Claims, 1 Drawing Sheet

SPIRAL LINK BELT WITH COMPOSITE HELICES

BACKGROUND OF THE INVENTION

The present invention relates to a spiral link belt composed of a multiplicity of meshing synthetic resin helices interconnected by inserted pintle wires and more specifically, to such a belt having composite helices.

Such spiral link belts are known from German Patent Publication No. 29 38 221. Only quite specific synthetic resins can be used for making the helices, namely materials that are capable of spiralling, e.g. polyester. The manufacture of helices from polyamide already meets with considerable difficulties since it is possible only with great effort to produce the helices so that the winding legs are disposed in one place. Normally, polyamide helices are twisted. It is not possible to produce helices from polyacrylic material, although this material would be especially suited on account of its high resistance to hydrolysis as material for producing spiral link belts used in the drying section of papermaking machines.

SUMMARY OF THE INVENTION

The present invention has the object of providing a spiral link belt with a wider range of application and allows a wider variation of the properties. This object is accomplished by having a plurality of helices comprised of two components, the first component being disposed on the inside of the helix and the second component on the outside of the helix.

By subdivision of the cross section of the helices into several components, it is possible to employ non-spiralling synthetic resins or other materials. All the helices, or only a limited number of the helices, of a spiral link belt can consist of a plurality of components. In the simplest case, each helix consists of two components, the first one of which is disposed on the inside of the helix with the second one on the outside of the helix. The first component disposed on the inside of the helix generally consists of spiralling material, particularly polyester. For the second component disposed on the outside of the helix, a wear-resistant material, e.g. polyamide, can be used. If the spiral link belt is to be used in the drying section of a papermaking machine, the second component preferably consists of polyetherether ketone, since said material is highly resistant to hydrolysis. Also, an acrylic multifilament yarn can be employed as a hydrolysis-resistant second component, e.g. Dralon T (trademark of Bayer AG).

In another embodiment, it is also advantageous to have the second component disposed at the outside of the helix comprised of polyester and the first component disposed at the inside of the helix comprised of polyetherether ketone (PEEK). Although polyetherether ketone has a higher abrasion resistance than polyester, this embodiment has the advantage that the hydrolysis resistant material (polyetherether keton) is not subjected to abrasion and therefore survives in full cross section up to the end of the service life of the spiral link belt. This embodiment is therefore expedient in such cases in which the service life of the spiral link belt is limited more by hydrolysis than by abrasion. The first component can here by a PEEK monofilament of 0.22 mm diameter which is in a groove of the second component which is a polyester monofilament of 0.6 mm diameter. The first component (PEEK) here has a weight proportion of about 7.5% by weight of the whole spiral link belt and a proportion of about 10% by weight of the helices themselves. When manufacturing these helices, both components are wound together on a mandrel.

The interface between the two components may be smooth. Normally there is no risk that the two components will shift relative to one another because the helices mesh with each other in the manner of a zipper so that the two components snugly lie with the winding arcs of one helix between the winding arcs of the adjacent helix, and are thus fixed in their mutual positions. However, it is also possible at the interface to make one component convex and the other one concave so that there is a sort of positive engagement between the two components. If the second component has a very small diameter compared with the entire helix, it is preferably embedded in a groove on the outside of the first component.

During thermosetting of the spiral link belt, the component disposed on the outside can be deformed. For example, if the second component disposed on the outside is a relatively thick multifilament yarn, the spiral link belt can additionally be pressed flat during thermosetting. Thereby, the second component spreads out and thus increases the contacting area.

As to the general technology concerning the manufacture of spiral link belts, reference is made to German Patent Publication No. 29 38 221. According to this publication, it is especially necessary that thermosetting is carried out such that the helices in the final spiral link belt no longer have any tension spring-like bias, i.e. the winding arcs are disposed closely side by side, but do not exert any substantial force on each other. Furthermore, during thermosetting, the winding arcs somewhat penetrate into the material of the pintle wires so that the latter assume a wavy configuration. The helices consisting of at least two components are manufactured such that the component consisting of spiralling material is wound on a mandrel in a manner known per se and is then pushed off said mandrel. Since this component generally does not have a round cross sectional profile and may be quadrangular or may have a groove in its outer surface, care must be taken that the helix wire is not turned about its longitudinal axis, i.e., that it retains its orientation. This is accomplished in that said wire is guided through a guide means matching the cross sectional profile of said wire before it is wound onto the mandrel. The other and possibly additional components are wound onto the mandrel together with the spiralling component. In order that the yarn or the wire of the other component is wound precisely over the spiralling component, the other component is guided through a guide means likewise corresponding to the profile of the other component, if the latter does not have a round cross section. Especially with material such as polyacrylic material, which does not spirallize, the second component can also be wound onto the helix previously formed from the first component.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
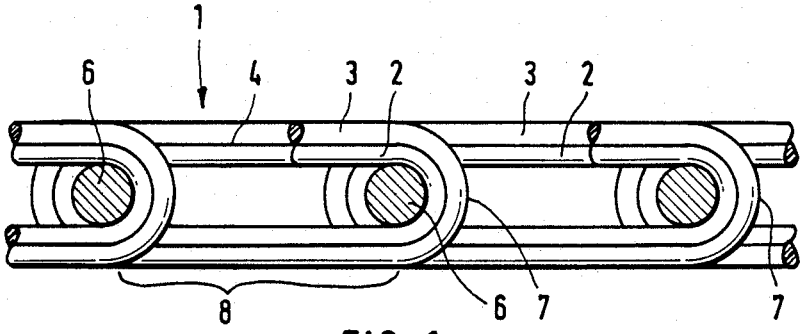
FIG. 1 is a sectional view in the longitudinal direction through the spiral link belt.

FIG. 1 illustrates a spiral link belt in longitudinal section. Each helix 1 consists of a multiplicity of elongated windings with winding arcs 7 and winding legs 8. The helices 1 mesh one with the other so that the winding arcs 7 of one helix mesh in zipper fashion with the winding arcs 7 of the two adjacent helices 1. The meshing winding arcs 7 overlap sufficiently to form a channel into which a pintle wire 6 is inserted.

The pintle wire 6 firmly connects the helices 1. The winding legs 8 form the upper side and the underside of the spiral link belt.

Figure 2:
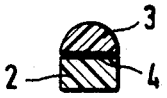
FIGS. 2 to 7 are cross sectional views through different embodiments of a helix wire composed of two components.

According to FIG. 1, each helix 1 is divided and consists of a first inner component 2 and a second outer component 3 wound over the first component 2. Both components have a substantially flat, nearly rectangular cross section. One or both components may also have a semicircular or calotte-like cross section, as shown in FIG. 2. the inner component 2 is a polyester monofilament, while the outer component 3 is a polyamide monofilament thus imparting an altogether higher wear resistance to the spiral link belt.

Figure 3:
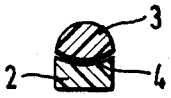

In order to improve the bond between the two components 2, 3 and to safeguard their mutual position, the interface 4 between the two components 2, 3, may have a curved cross section to provide a certain positive engagement between the two components 2, 3, as shown in FIG. 3.

Figure 4:
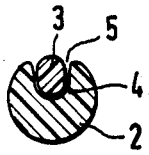

In the example illustrated by FIG. 4, the first, inner component 2 is a polyester monofilament of round cross section having a 0.6 mm diameter and provided with an outwardly open groove 5 which is 0.2 mm deep. In the manufacture of the helix, a polyetherether ketone monofilament of 0.2 mm diameter is inserted into the groove 5. Under the conditions existing on papermaking machines, polyetherether ketone has a very high stability which is substantially higher than that of polyester, for example. On account of the high cost, polyetherether ketone has hitherto not been used to a substantial extent for making paper machine fabrics. Since in the example of FIG. 4, the second component 3 consisting of polyetherether ketone has a substantially smaller diameter than the helix 1 as a whole, the cost remains at a level that is generally acceptable. Even if the first component 2 of polyester is completely destroyed, the second component 3 made of 0.2 mm thickness polyetherether ketone monofilament is strong enough to hold the spiral link belt together. This allows substantially longer service periods.

A multifilament yarn or a spun yarn can be placed into the groove 5, as the second component 3. This yarn need not be thermosettable since the first component 2 consisting of polyester functions as a support for holding the multifilament or spun yarn. The second component therefore may consist of an acrylic multifilament yarn, for example, as commercially available by the tradename Dralon-T. Compared with polyester, this acrylic multifilament yarn is far more resistant to hydrolysis than polyester. Acrylic multifilament yarns alone cannot be formed into helices as they cannot be thermoset in a predetermined shape.

Figure 5:
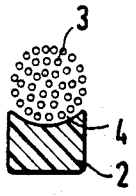

In the example illustrated by FIG. 5, the properties of polyester and acrylic resin are utilized. The polyester provides the required stability, while the acrylic multifilament yarn disposed on the outside of the helix 1 imparts stability against hydrolysis. The outside of the helix is especially prone to hydrolysis.

Figure 6:
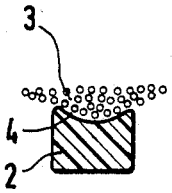

The thickness of the acrylic multifilament yarn forming the second component 3 can be selected such that it either precisely fills the groove 5 in the first component 2 or somewhat protrudes therefrom. Thereby, a soft surface is imparted to the spiral link belt, which results in improved marking characteristics. Moreover, this enlarges the contacting area on which the paper is pressed against the heated drying drums of the papermaking machine. In the example of FIGS. 5 and 6, the first, internal component is a polyester monofilament of approximately square cross section of $0.6\times0.6$ mm. The outwardly directed surface of the first component 2 has a concave configuration so that it forms a groove 5 with a maximum depth of 0.2 mm. A multifilament yarn, a spun yarn, or a monofilament thread (e.g. $6\times0.2$ mm) can be placed in the groove 5 as a second component 3. Suitably, the second component 3 consists of a thermoplastic synthetic resin, although this is not compulsory. The thickness of the inserted yarn of the second component 3 is preferably 0.6 to 0.7 mm, i.e. it is somewhat larger than the dimension of the nearly square component 2.

As shown in FIG. 5, the inserted yarn 3 lies on the polyester wire 2 thereby increasing substantially the overall dimension of the helix 1. A spiral link belt comprised of such a helix 1 can be pressed during thermosetting so that, under the influence of temperature and pressure, the cross section of the inserted yarn 3 can be deformed and flattened as shown in Figure 6. The transverse dimension of the second component 3, i.e. of the inserted yarn, increases, and it is possible to flatten the inserted yarn to the extent that the portions of the inserted yarn 3 belonging to adjacent winding legs 8 of a helix 1 contact each other and form an uninterrupted surface of the spiral link belt. A closed, soft surface substantially eliminates marking and enlarges the area pressing the paper against the drying cylinders. At the same time, the air permeability of the spiral link belt is reduced.

The second component disposed on the outside of the helices can also be a metal wire or a reflecting material. A metal wire, for example, can reduce static electricity or can improve warming-up of the paper.

Figure 7:
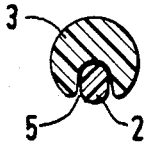

FIG. 7 shows an embodiment wherein the first inner component 2 is a polyetherether ketone (PEEK) monofilamnet disposed in a groove 5 of a polyester monofilament forming the second outer component 3. This embodiment uses the same materials as the embodiment of FIG. 4 but the orientation of the two-component thread the helices are wound from is reversed. The embodiment of FIG. 7 is advantageous in applications where the spiral link belt undergoes strong hydrolysis.

While the invention has been particularly shown and described with reference to preferred embodiments thereof, it will be understood by those in the art that the foregoing and other changes in form and details may be made therein without departing from the spirit and scope of the invention.

What is claimed is:

1. A spiral link belt comprising a multiplicity of synthetic resin helices comprised of flat winding legs and winding arcs, the winding arcs of a helix meshing in zipper fashion with the winding arcs of adjacent helices, and pintle wires inserted into the channels formed by the meshing winding arcs of each two helices, wherein a plurality of helices are each made of filament material which has at least two components which contact each other along an interface extending along the length of the helix, the helices being wound such that a first component is disposed on the inside of the helix and a second component is disposed on the outside of the helix.

2. A spiral link belt according to claim 1, wherein the interface has a concave or a convex configuration.

3. A spiral link belt according to claim 1, wherein the second component disposed on the outside is embedded in a groove in the first component.

4. A spiral link belt according to claim 3, wherein the first component consists of polyester and the second component consists of polyetherether ketone.

5. A spiral link belt according to claim 3, wherein the first component consists of polyester and the second component is an acrylic multifilament yarn or a spun yarn.

6. A spiral link belt according to claim 1, wherein the second component has a flat cross section with a greater transverse dimension than the first component.

7. A spiral link belt according to claim 1, wherein the first component disposed on the inside is a polyetherether ketone monofilament which is embedded in a groove in the second component disposed on the outside which is a polyester monofilament.

* * * * *